US005855368A

United States Patent [19]

Middelberg et al.

[11] Patent Number: 5,855,368

[45] Date of Patent: Jan. 5, 1999

[54] EXTENSION APPARATUS AND METHOD

[75] Inventors: Neal J. Middelberg, Apex, N.C.; Gregory T. Lucas, Huntington Beach, Calif.; Daniel C. Park, West Linn, Oreg.

[73] Assignee: Bell & Howell Mail Processing Systems, Durham, N.C.

[21] Appl. No.: 771,587

[22] Filed: Dec. 20, 1996

[51] Int. Cl.[6] ..... B65H 5/02

[52] U.S. Cl. ..... 271/272; 271/275; 271/198; 198/588; 198/812

[58] Field of Search ..... 271/198, 200, 271/272–274, 275; 198/588, 812

[56] References Cited

U.S. PATENT DOCUMENTS

| | | | |
|---|---|---|---|
| 4,002,249 | 1/1977 | Shinomiya et al. | 271/200 X |
| 4,241,559 | 12/1980 | Klapp | 271/200 X |
| 5,722,655 | 3/1998 | Reist | 271/275 X |

FOREIGN PATENT DOCUMENTS

| | | | |
|---|---|---|---|
| 1556022 | 1/1970 | Germany | 198/812 |
| 2150021 | 4/1973 | Germany | 271/275 |
| 265835 | 10/1990 | Japan | 271/272 |
| 698847 | 12/1979 | U.S.S.R. | 198/812 |

*Primary Examiner*—Boris Milef
*Attorney, Agent, or Firm*—Jenkins & Wilson, P.A.

[57] ABSTRACT

The present invention provides a novel extension apparatus and method for providing a selectively adjustable conveying path for sheet articles between sheet processing apparatuses. The extension apparatus includes a base bracket with a pair of rotatably movable spring-loaded bracket arms attached to a shaft extending therethrough. A pair of bracket arm rollers are attached to each of the bracket arms. An extension plate is positioned above and slidably movable on the base bracket, and a pair of rotatable extension rollers are rotatably attached to a shaft extending through the extension plate such that slidable movement of the extension plate simultaneously and identically moves the extension rollers. A pair of rear rollers are utilized and are operatively aligned with an extension roller and a pair of the bracket arm rollers. A pair of belts extend at least partially around and operatively engage one of the rear rollers, one of the extension rollers, and a pair of the bracket arm rollers of one of the bracket arms. The belts have an upper reach section and a lower reach section between the rear rollers and the extension rollers, and the upper reach section of the belts form a conveying path for advancement of sheet articles while the bracket arm rollers engage each belt in the lower reach section.

16 Claims, 5 Drawing Sheets

EXTENSION APPARATUS AND METHOD

TECHNICAL FIELD

The present invention relates generally to apparatuses and methods for providing a conveying path for advancement of sheet articles between one sheet processing apparatus and another downstream sheet processing apparatus. More particularly, the present invention relates to a novel extension apparatus and method for providing a selectively adjustable conveying path between the delivery end of one sheet processing apparatus and another downstream sheet apparatus wherein the extension apparatus can be positioned in an abutting manner to the downstream sheet processing apparatus.

BACKGROUND ART

As is well-recognized in the art of sheet processing, a need commonly exists for providing a conveying path of various lengths between an end of one sheet processing apparatus and another downstream sheet processing apparatus in order to advance sheet articles on the conveying path from the first apparatus to the second. This task can be difficult since space restrictions usually exist when operatively configuring sheet processing components.

To provide a conveying path of various lengths between the delivery end of one sheet processing apparatus and another downstream sheet processing apparatus, it has been common in the past to utilize an adjustably extendable and retractable extension table with a plurality of belts thereon for advancing sheet articles. The extension table utilizes a translational method of extension and includes a sliding belt and pulley mechanism that fixedly protrudes in a direction toward the downstream sheet processing apparatus in order for the extension table to be extendable. One disadvantage to such an extension table is that it can only be placed as close to a downstream sheet processing apparatus as the fixedly protruding sliding mechanism will allow. It has therefore not heretofore been possible to position such an extension table in a completely abutting manner to a downstream sheet processing apparatus since doing so would require the protruding sliding mechanism to protrude into the abutting downstream sheet processing apparatus. Another disadvantage suffered by such an extension table is that tension in the belts thereof typically has to be adjusted manually by adjustment of hardware associated therewith for the extension table to be extended to various lengths.

In light of the prior art extension table as discussed hereinabove, there remains much room for improvement in the art for an extension apparatus and method providing a selectively adjustable conveying path for sheet articles between the delivery end of one sheet processing apparatus and another downstream sheet processing apparatus where the extension apparatus can abut a downstream sheet processing apparatus and wherein tension on the belts of the extension apparatus can remain constant when the extension apparatus is extended or retracted without manual adjustment thereof.

SUMMARY OF THE INVENTION

The present invention provides a novel extension apparatus and method for providing a selectively adjustable conveying path for sheet articles between one sheet processing apparatus and another downstream sheet processing apparatus. In a preferred embodiment, the extension apparatus comprises a base bracket having a front face in a vertical plane wherein the base bracket is adapted for being maintained in a stationary position. A pair of rotatably movable bracket arms are attached to a shaft extending through and from opposing sides of the base bracket. Torsion springs are used to bias each of the bracket arms in position, and a pair of spaced-apart bracket arm rollers are attached to each of the bracket arms. An extension plate is positioned above and slidably movable on the base bracket, and a pair of rotatable extension rollers are rotatably attached to a shaft extending through the extension plate such that slidable movement of the extension plate simultaneously and identically moves the extension rollers.

A pair of rear rollers are utilized which can be part of an upstream sheet processing apparatus to which the extension apparatus can be operatively attached. Each of the rear rollers are operatively aligned with an extension roller and a pair of the bracket arm rollers. A pair of belts extend at least partially around and operatively engage one of the rear rollers, one of the extension rollers, and a pair of the bracket arm rollers of one of the bracket arms. The belts have an upper reach section and a lower reach section between the rear rollers and the extension rollers, and the upper reach section of the belts form a conveying path for advancement of sheet articles while the bracket arm rollers engage each belt in the lower reach section.

According to this invention, the extension rollers can be selectively extended away from or retracted toward the rear rollers to selectively extend or retract the conveying path provided by the belts wherein the bracket arms are caused by the belts to rotate such that tension on said belts remains substantially constant in an extended position and a retracted position. The belts can operatively cooperate with other belts, such as those of an upstream sheet processing apparatus, to advance sheet articles along the conveying path between the belts. Quite advantageously, the bracket arms can remain behind the vertical plane of the front face of the base plate when the extension apparatus is in an extended position.

It is therefore an object of the present invention to provide a novel extension apparatus and method for providing a selectively adjustable conveying path for sheet articles between one sheet processing apparatus and another downstream sheet processing apparatus.

It is another object of the present invention to provide an extension apparatus and method which can be operatively positioned in an abutting manner to a downstream sheet processing apparatus for providing a selectively adjustable conveying path for sheet articles to be advanced thereto.

It is a further object of the present invention to provide an extension apparatus and method utilizing belts to provide a selectively adjustable conveying path wherein tension of the belts remains constant regardless of whether the extension apparatus is in an extended position or a retracted position.

Some of the objects of the invention having been stated hereinabove, other objects will become evident as the description proceeds, when taken in connection with the accompanying drawings as best described hereinbelow.

DETAILED DESCRIPTION OF THE INVENTION

In accordance with the present invention, a selectively adjustable extension apparatus generally designated 10 is provided for attachment to the delivery end of an upstream sheet processing apparatus for providing a selectively adjustable extension of the conveying path of the upstream sheet processing apparatus. Extension apparatus 10 can be advantageously be utilized to provide a suitable conveying path extension between an upstream sheet processing apparatus, such as a collector or stager, and a downstream sheet processing apparatus, such as a raceway for sheet articles. It is envisioned according to the present invention that extension apparatus 10 could be operatively attached to an end of any suitable sheet processing apparatus to provide a selectively adjustable conveying path for advancing single or stacked sheet articles from the sheet processing apparatus, along the conveying path provided by extension apparatus 10, and to another suitable sheet processing apparatus.

Figure 2:
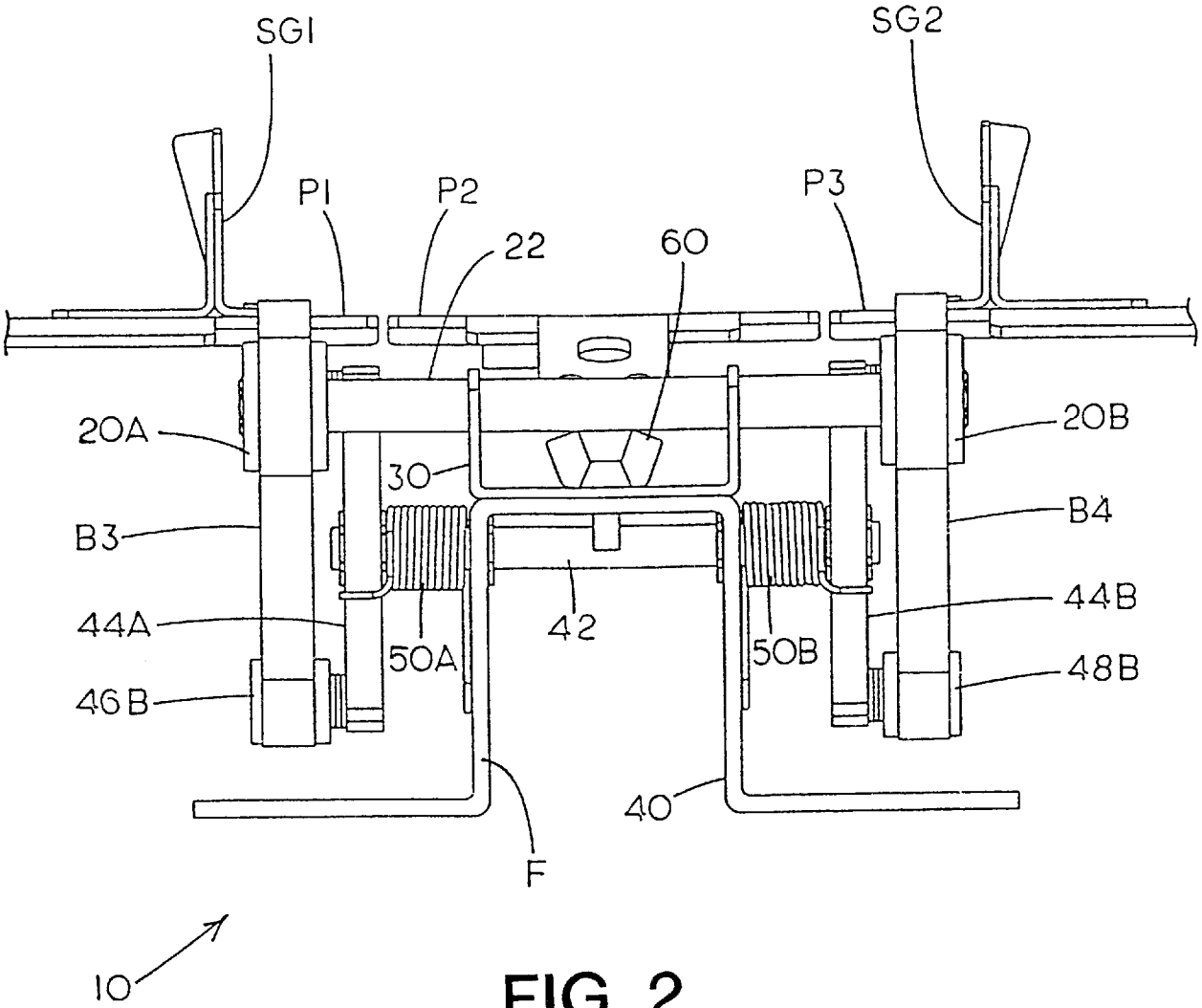
FIG. 2 of the drawings is a front view of the extension apparatus of FIG. 1 with the upper roller assembly of the upstream sheet processing apparatus removed therefrom and with side guides for guiding sheets on the upstream sheet processing apparatus.

As shown in the various figures of drawings, extension apparatus 10 is operatively connected with and to the delivery end of an upstream sheet processing apparatus which includes support plates P1, P2 and P3 for supporting sheet articles as they are advanced from the sheet article processing apparatus to exit between exit rollers R1 and R2 and R3 and R4. As shown in FIG. 2, opposing side guides SG1 and SG2 can be used to guide sheet articles on the conveying path on support plates P1, P2 and P3. Exit rollers R1 and R3 are upper exit rollers and are operatively positioned above lower exit rollers R2 and R4, respectively, which are drive rollers attached to drive shaft DS.

The delivery end of the upstream sheet processing apparatus to which extension apparatus 10 is operatively attached can include an upper roller assembly comprising shaft S1 to which arms A1 and A2 are suitably attached with upper exit rollers R1 and R3 movably attached to ends of arms A1 and A2, respectively, as idler rollers. Outer arms A3 and A4 are also be attached to shaft S1, and shaft S2 extends between ends of shaft S2 opposite shaft S1. Idler end rollers R5 and R6 are movably attached to shaft S2, and a pair of upper belts B1 and B2 extend around and engage upper exit rollers R1, R3 and end rollers R5, R6, respectively, such that upper belts B1 and B2 are idler belts.

According to this invention, a preferred embodiment of extension apparatus 10 is illustrated in the various figures of drawings and comprises spaced-apart belts B3 and B4 adapted for operative cooperation below and with upper belts B1 and B2, respectively, for providing a conveying path therebetween for advancement therethrough of sheet articles exiting the upstream sheet processing apparatus. Belts B3 and B4 extend around rear drive rollers which can be lower exit rollers R2 and R4, respectively, and also extend around a pair of extension rollers 20A and 20B, respectively, which are attached as idler rollers to shaft 22. It is envisioned according to this invention, however, that extension apparatus 10 could include rear rollers other than lower exit rollers R2 and R4 of the delivery end of an upstream sheet processing apparatus wherein extension apparatus 10 could include and utilize its own components rather than utilizing components of the delivery end of an upstream sheet processing apparatus.

A U-shaped extension plate 30 is positioned between extension rollers 20A and 20B as extension rollers 20A and 20B are movably attached to shaft 22 which extends through apertures defined in upwardly extending flanges of extension plate 30. The center flat portion of extension plate 30 defines a central slot 32 therethrough for positioning of a fastener, such as thumbscrew 60, as discussed further hereinbelow.

Extension plate 30 with shaft 22 and extension rollers 20A and 20B is slidable on a base bracket 40 which is in the shape of an inverted "U" and is adapted for being maintained in a fixed position during extension and retraction of extension plate 30. As such, base bracket 40 can be fixedly attached to a suitable object, such as, for example, a support frame. Extending through and from opposite sides of base bracket 40 is shaft 42, and bracket arms 44A and 44B, respectively, are movably attached thereto on opposing ends thereof. Bracket arms 44A and 44B each have a pair of idler pulleys 46A, 46B and 48A, 48B, respectively, movably attached to a shaft on each of the ends of bracket arms 44A and 44B. As illustrated in the various figures of drawings, belts B3 and B4 of extension apparatus 10 extend in a serpentine manner around and between the pair of idler pulleys of each bracket arm 44A and 44B, respectively.

As an advantageous feature of the present invention, the tension on belts B3 and B4 can remain constant regardless of whether extension apparatus 10 is in an extended position or a retracted position. In order to accomplish this, torsion springs 50A and 50B, best illustrated in FIG. 2, are utilized between bracket arm 44A and base bracket 40 and between bracket arm 44B and base bracket 40, respectively, such that torsion springs 50A and 50B bias bracket arms 44A and 44B, respectively, in position in a predetermined manner. A portion of torsion springs 50A and 50B can suitably biasedly engage pegs 52A and 52B, respectively, as best shown in FIGS. 2 and 3B of the drawings. Rotational movement of bracket arms 44A and 44B is therefore spring-loaded, and the tension in belts B3 and B4 can be controlled by torsion springs 50A and 50B, respectively. As will be apparent to those of skill in the art, the tension of belts B3 and B4 can therefore be adjusted by changing torsion springs 50A and 50B, respectively, or by modifying the amount of preload put on them during installation.

Figure 1A:
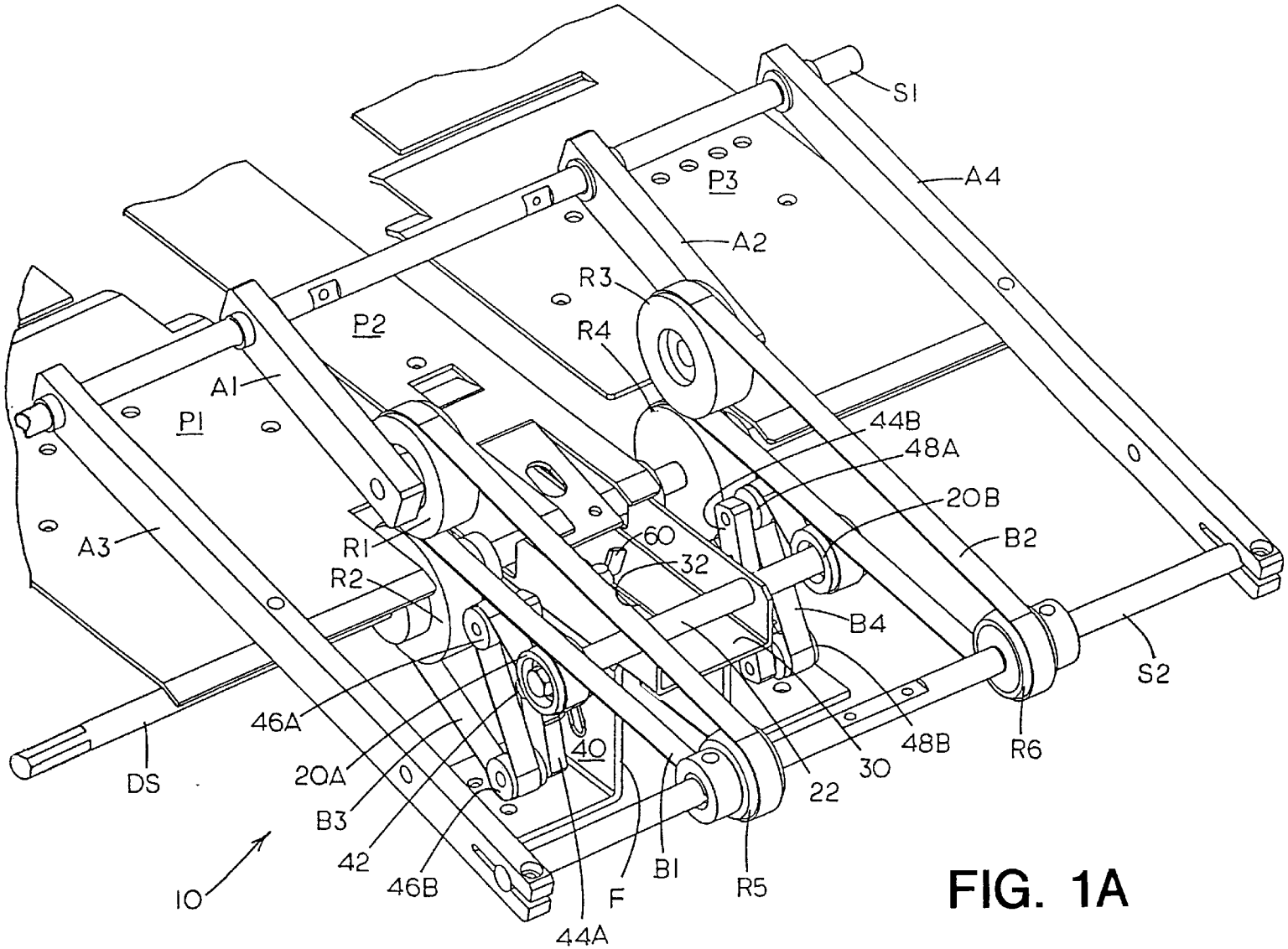
FIG. 1A of the drawings is a perspective view of a preferred embodiment of the extension apparatus according to the present invention in a retracted position and attached to the delivery end of an upstream sheet processing apparatus.
Figure 3A:
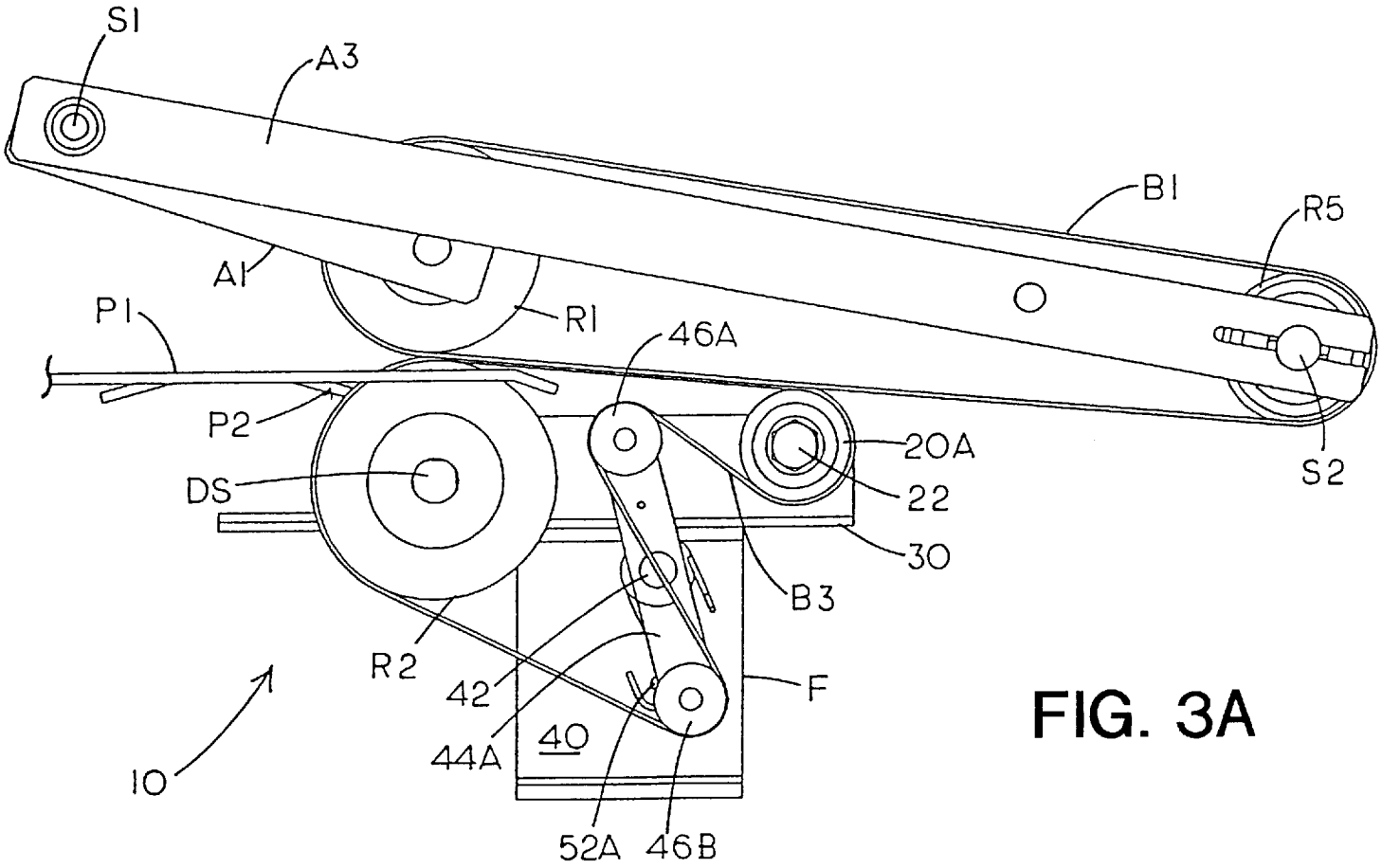
FIG. 3A of the drawings is a side elevation view of the extension apparatus of FIG. 1A.
Figure 3B:
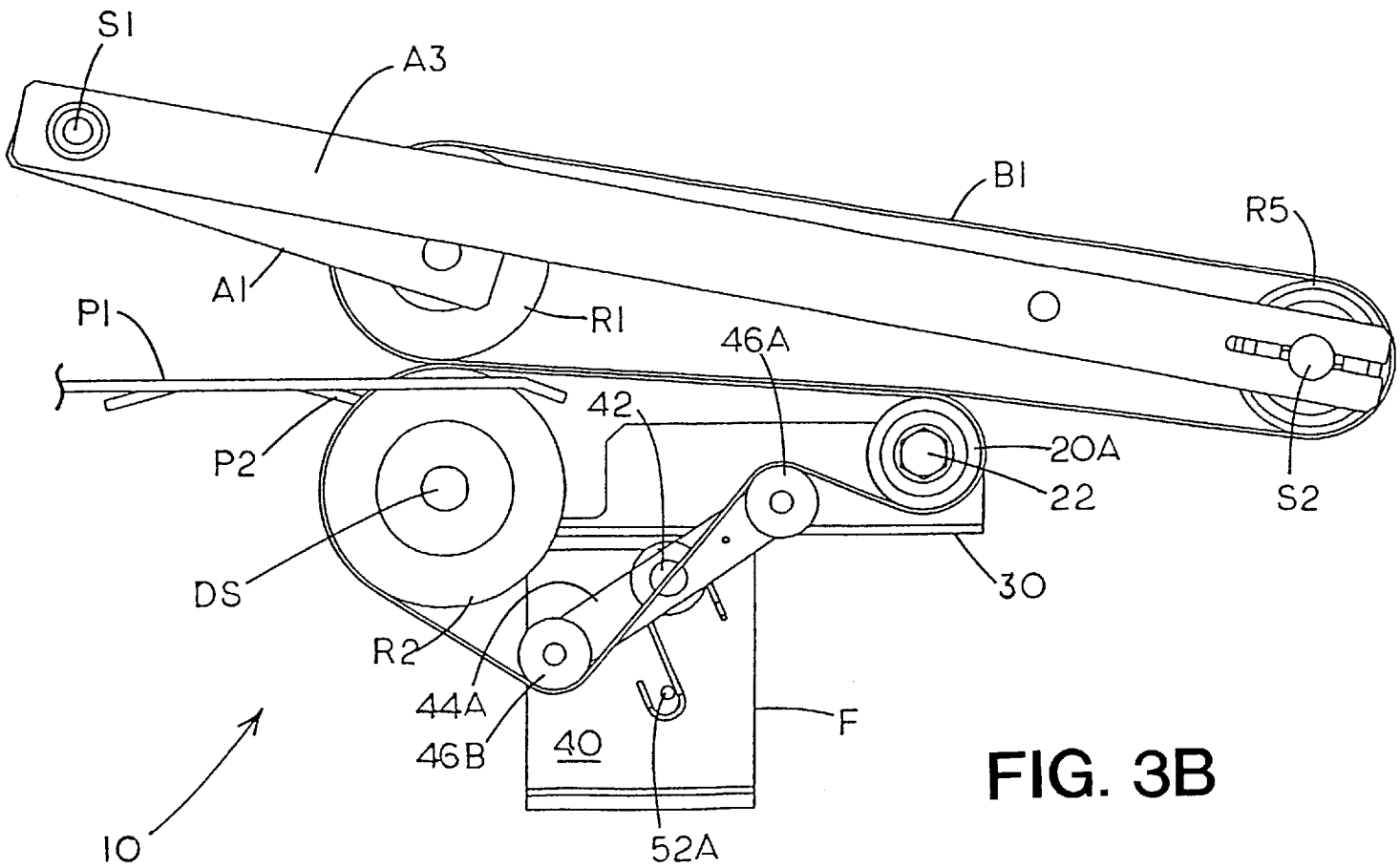
FIG. 3B of the drawings is a side elevation view of the extension apparatus of FIG. 1B.

FIGS. 1A, 2 and 3A of the drawings illustrate extension apparatus 10 in a retracted position. Lower exit rollers R2 and R4, although operatively utilized in association with extension apparatus 10, are preferably not horizontally movable so as to extend or retract and therefore will remain in a horizontally stationary position during extension and retraction of extension apparatus 10. As best illustrated in FIGS. 1A and 3A, bracket arms 44A and 44B are almost in a vertical position, as biased by torsion springs 50A and 50B, with pulleys 46A and 48A being positioned almost directly above pulleys 46B and 48B, respectively. Thumbscrew 60 can fasten extension plate 30 in position against base bracket 40 to maintain extension apparatus 10 in the retracted position. As discussed further hereinbelow, the distances shown in FIGS. 1A and 3A separating extension rollers 20A, 20B and lower exit rollers R2, R4, respectively, is shorter than what such distances will be when extension apparatus 10 is in an extended position. The distances between extension rollers 20A, 20B and lower exit rollers R2, R4, respectively, determine the extent to which belts B3 and B4, respectively can operatively cooperate with upper belts B1 and B2, respectively, in order to advance sheet articles therebetween.

Figure 1B:
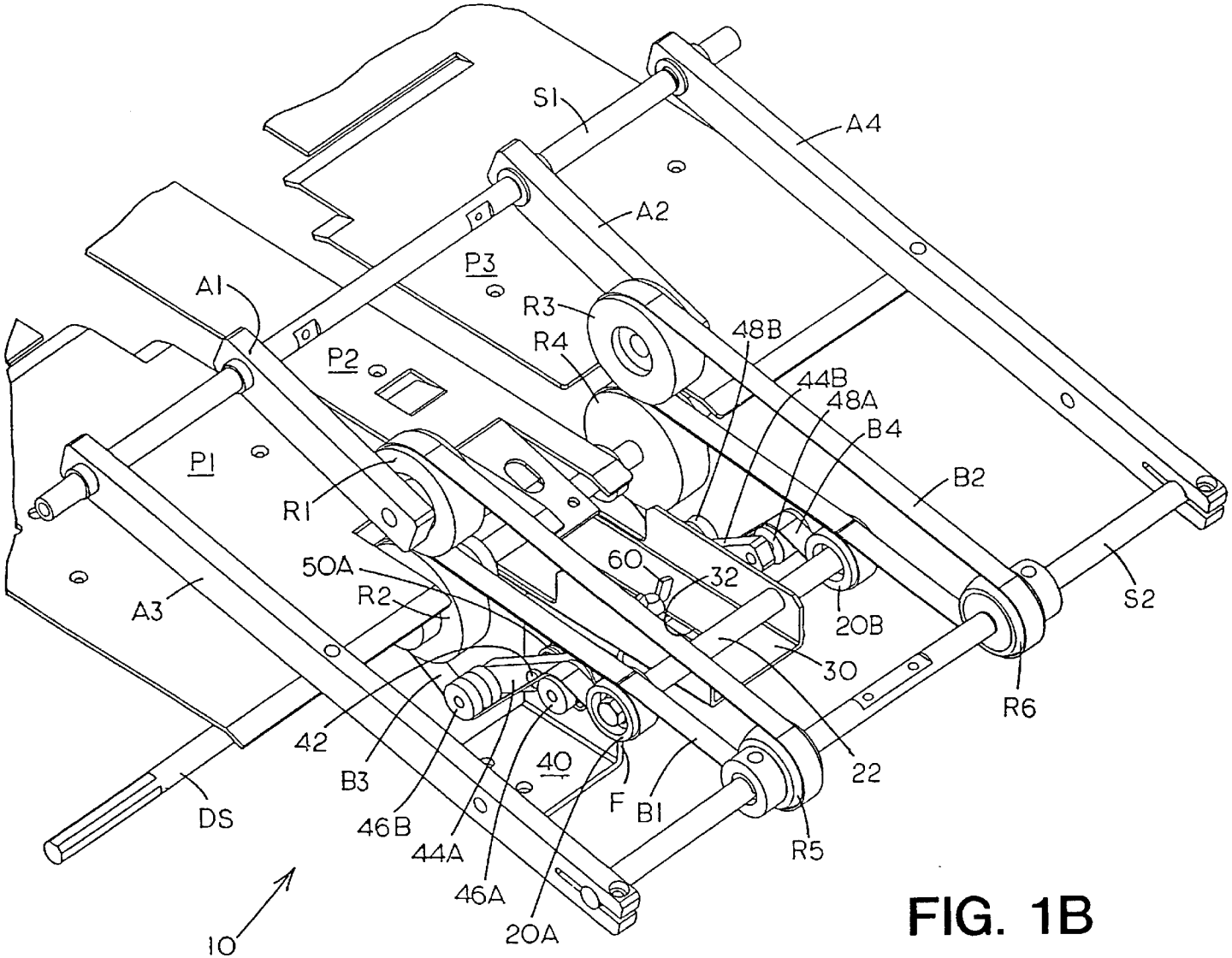
FIG. 1B of the drawings is a perspective view of the extension apparatus of FIG. 1 in an extended position.

FIGS. 1B and 3B of the drawings illustrate extension apparatus 10 in an extended position. While lower exit rollers R2 and R4 remain in the same horizontal positions as in the retracted position of FIGS. 1A and 3A, extension rollers 20A and 20B are further extended in at least substantially horizontal direction away from lower exit rollers R2 and R4, respectively, and support plates P1, P2 and P3. To reach the extended position as shown, thumbscrew 60 can be loosened while extension apparatus 10 is in a retracted position such as that shown in FIGS. 1A and 3A, and extension plate 30 and/or shaft 22 passing therethrough can be manually moved in the direction away from lower exit rollers R2 and R4 and support plates P1, P2 and P3 while thumbscrew 60 can remain loosely attached to base bracket 40. In this manner, extension plate 30 slides on top of base bracket 40 with thumbscrew 60 remaining in an extended position through slot 32 of extension plate 30. Once extension apparatus 10 has been extended to a position as desired by manually sliding extension plate 30 in the direction away from support plates P1, P2 and P3, thumbscrew 60 can then be tightened to fasten and fixedly position extension plate 30 against base bracket 40 to maintain extension apparatus 10 in the extended position selected. It can therefore be readily understood that extension apparatus 10 can be selectively and adjustably extended and retracted by manual manipulation of extension apparatus 10.

The actual length and tension of belts B3 and B4 remains constant whether extension apparatus 10 is in a retracted position or an extended position. Extending extension plate 30 and therefore extension rollers 20A and 20B increases the distance within which belts B3 and B4 can operatively cooperate with upper belts B1 and B2, respectively, to advance sheet articles on the conveying path therebetween. Such extension also understandably causes belts B3 and B4 to pull the idler pulleys of each of bracket arms 44A and 44B to simultaneously rotate bracket arms 44A and 44B on shafts 42A and 42B, respectively, in a clockwise direction against the biasing force of torsion springs 50A and 50B on bracket arms 44A and 44B, respectively. The tension on belts B3 and B4 can therefore remain constant for extension apparatus 10 in a retracted position as well as in an extended position.

As shown in FIGS. 1B and 3B of the drawings, bracket arms 44A and 44B have rotated in a clockwise direction away from their nearly vertical position shown in FIGS. 1A and 3A of the drawings. As will be apparent to those of skill in the art, the amount of maximum extension of extension apparatus 10 is controlled by the length of belts B3 and B4 as well as the length of bracket arms 44A and 44B and proximity of bracket arms 44A and 44B to lower exit rollers R2 and R4, respectively. As an advantageous feature of the present invention, extension apparatus 10 can be selectively adjusted to an extended position wherein bracket arms 44A and 44B do not extend past a predetermined front vertical plane which can be below extension plate 30. In this manner, extension apparatus 10 can be positioned in an abutting manner to a downstream sheet processing component wherein a portion, such as a corner, of the downstream sheet processing component can abut outer face F of base bracket 40 such that extension plate 30 can be selectively extended above a portion such as a corner of the downstream sheet processing component.

Extension apparatus 10 therefore provides a selectively adjustable conveying path for sheet articles between an upstream sheet processing apparatus and a downstream sheet processing apparatus. Sheet articles advanced on support plates P1, P2 and P3 to exit the upstream sheet processing apparatus therefore pass between belts B1, B2 and B3, B4, respectively. Driven rotation of lower exit rollers R2 and R4 rotates belts B3 and B4, respectively, clockwise in a direction to advance the sheet articles on the conveying path away from the upstream sheet processing apparatus as upper belts B1 and B2 operatively cooperate with belts B3 and B4, respectively, as idler belts for facilitating advancement of sheet articles through the conveying path therebetween.

It can therefore be understood that the present invention provides a novel extension apparatus and method for providing a selectively adjustable conveying path for sheet articles between one sheet processing apparatus and another downstream sheet processing apparatus. It can also be understood that the present invention provides an extension apparatus and method which can be operatively positioned in an abutting manner to a downstream sheet processing apparatus for providing a selectively adjustable conveying path for sheet articles to be advanced thereto. As can be appreciated, the extension apparatus and method of the present invention utilizes belts to provide a selectively adjustable conveyuing path wherein tension of the belts remains constant regardless of whether the extension apparatus is in an extended position or a retracted position.

It will be understood that various details of the invention may be changed without departing from the scope of the invention. Furthermore, the foregoing description is for the purpose of illustration only, and not for the purpose of limitation, as the invention is defined by the following, appended claims.

What is claimed is:

1. An extension apparatus for providing a selectively extendable conveying path for advancement of sheet articles through the conveying path, said extension apparatus comprising:

(a) a base bracket adapted for being maintained in a stationary position, said base bracket having a pair of rotatably movable bracket arms positioned on opposing sides of said base bracket wherein a biasing member biases each of said bracket arms in position, said bracket arms each having at least a pair of bracket arm rollers rotatably attached thereto;

(b) an extension plate positioned above and slidably movable on said base bracket, said extension plate having at least a pair of rotatable extension rollers positioned on opposing sides of said extension plate and operatively attached thereto;

(c) at least a pair of rear rollers wherein each rear roller is operatively aligned with an extension roller and at least a pair of said bracket arm rollers; and (d) at least a pair of belts, each of said belts extending at least partially around and operatively engaging one of said rear rollers, one of said extension rollers, and at least a pair of said bracket arm rollers of at least one of said bracket arms such that said belts provide a conveying path between said rear rollers and said extension rollers for advancement of sheet articles through the conveying path;

(e) whereby said extension rollers can be selectively extended away from or retracted toward said rear rollers to selectively extend or retract the conveying path provided by said belts wherein said bracket arms are caused by said belts to rotate such that tension on said belts remains substantially constant in an extended position and a retracted position.

2. The extension apparatus of claim 1 wherein said base bracket has a front face in a vertical plane and wherein said bracket arms can remain behind the vertical plane of said front face when said extension apparatus is in an extended position.

3. The extension apparatus of claim 1 wherein said bracket arms are rotatably attached to a shaft extending from said base bracket.

4. The extension apparatus of claim 1 wherein said biasing members biasing said bracket arms comprise torsion springs.

5. The extension apparatus of claim 1 wherein said belts have an upper reach section and a lower reach section between said rear rollers and said extension rollers, and wherein the upper reach section forms the conveying path and said bracket arm rollers engage each belt in the lower reach section.

6. The extension apparatus of claim 1 further comprising an adjustable fastener for fastening said extension plate to said base bracket.

7. The extension apparatus of claim 1 wherein said rear rollers are part of an upstream sheet processing apparatus to which said extension apparatus is attached.

8. The extension apparatus of claim 1 wherein said belts are positioned at least substantially against other belts to form the conveying path for operatively cooperating with the other belts to advance sheet articles therebetween.

9. The extension apparatus of claim 8 wherein the other belts are attached to an upstream sheet processing apparatus.

10. An extension apparatus for providing a selectively extendable conveying path for advancement of sheet articles through the conveying path, said extension apparatus comprising:

(a) a base bracket having a front face in a vertical plane, said base bracket being adapted for being maintained in a stationary position;

(b) a pair of rotatably movable bracket arms attached to a shaft extending through and from opposing sides of said base bracket;

(c) a biasing member biasing each of said bracket arms in a predetermined position;

(d) a pair of spaced-apart bracket arm rollers attached to each of said bracket arms;

(e) an extension plate positioned above and slidably movable on said base bracket;

(f) a pair of rotatable extension rollers rotatably attached to a shaft extending through said extension plate such that slidable movement of said extension plate simultaneously and identically moves said extension rollers;

(g) a pair of rear rollers each being operatively aligned with an extension roller and a pair of said bracket arm rollers; and (h) a pair of belts, each of said belts extending at least partially around and operatively engaging one of said rear rollers, one of said extension rollers, and a pair of said bracket arm rollers of one of said bracket arms wherein said belts have an upper reach section and a lower reach section between said rear rollers and said extension rollers, and wherein the upper reach section forms a conveying path for advancement of sheet articles and said bracket arm rollers engage each belt in the lower reach section;

(i) whereby said extension rollers can be selectively extended away from or retracted toward said rear rollers to selectively extend or retract the conveying path provided by said belts wherein said bracket arms are caused by said belts to rotate such that tension on said belts remains substantially constant in an extended position and a retracted position and wherein said bracket arms can remain behind the vertical plane of said front face of said base plate when said extension apparatus is in an extended position.

11. The extension apparatus of claim 10 wherein said rear rollers are part of an upstream sheet processing apparatus to which said extension apparatus is attached.

12. The extension apparatus of claim 10 wherein said belts are positioned substantially against other belts to form the conveying path for operatively cooperating with the other belts to advance sheet articles therebetween.

13. A method of selectively extending a conveying path provided by one or more belts for advancement of sheet articles said method comprising the steps of:

(a) providing an extension apparatus for providing a selectively extendable conveying path for advancement of sheet articles through the conveying path, said I extension apparatus comprising:

(i) a base bracket adapted for being maintained in a stationary position, said base bracket having a pair of rotatably movable bracket arms positioned on opposing sides of said base bracket wherein a biasing member biases each of said bracket arms in position, said bracket arms each having at least a pair of bracket arm rollers rotatably attached thereto;

(ii) an extension plate positioned above and slidably movable on said base bracket, said extension plate having at least a pair of rotatable extension rollers positioned on opposing sides of said extension plate and operatively attached thereto;

(iii) at least a pair of rear rollers wherein each rear roller is operatively aligned with an extension roller and at least a pair of said bracket arm rollers; and (iv) at least a pair of belts, each of said belts extending at least partially around and operatively engaging one of said rear rollers, one of said extension rollers, and at least a pair of said bracket arm rollers of at least one of said bracket arms such that said belts provide a conveying path between said rear rollers and said extension rollers for advancement of sheet articles through the conveying path;

(b) selectively moving said extension rollers away from said rear rollers to selectively extend the conveying path provided by said belts from an original position with a first length to an extended position with a second length; and (c) wherein said bracket arms are caused by said belts to rotate such that tension on said belts remains substantially constant in the first length and the second length.

14. The method of claim 13 including the additional step of selectively retracting said extension rollers to selectively retract the conveying path.

15. A method of selectively extending a conveying path provided by one or more belts for advancement of sheet articles said method comprising the steps of:

(a) providing an extension apparatus for providing a selectively extendable conveying path for advancement of sheet articles through the conveying path, said extension apparatus comprising:

(i) a base bracket having a front face and being adapted for being maintained in a stationary position, said base bracket having a pair of rotatably movable bracket arms positioned on opposing sides of said base bracket wherein a biasing member biases each of said bracket arms in position, said bracket arms each having at least a pair of bracket arm rollers rotatably attached thereto;

(ii) an extension plate positioned above and slidably movable on said base bracket, said extension plate having at least a pair of rotatable extension rollers positioned on opposing sides of said extension plate and operatively attached thereto;

(iii) at least a pair of rear rollers wherein each rear roller is operatively aligned with an extension roller and at least a pair of said bracket arm rollers; and (iv) at least a pair of belts, each of said belts extending at least partially around and operatively engaging one of said rear rollers, one of said extension rollers, and at least a pair of said bracket arm rollers of at least one of said bracket arms such that said belts provide a conveying path between said rear rollers and said extension rollers for advancement of sheet articles through the conveying path;

(b) selectively moving said extension rollers away from said rear rollers to selectively extend the conveying path provided by said belts from an original position with a first length to an extended position with a second length; and (c) wherein said bracket arms are caused by said belts to rotate such that said bracket arms rotate without extending past the face of said base bracket.

16. The method of claim 15 including the additional step of selectively retracting said extension rollers to selectively retract the conveying path.

* * * * *